US012594454B2

(12) United States Patent
Larson et al.

(10) Patent No.: US 12,594,454 B2
(45) Date of Patent: Apr. 7, 2026

(54) TROLLEY ASSEMBLY AND WEIGHT ARM

(71) Applicant: Rep Fitness LLC, Westminster, CO (US)

(72) Inventors: Joseph G. Larson, Westminster, CO (US); Samuel M. Pizer, Denver, CO (US); Ryan James McGrotty, Westminster, CO (US)

(73) Assignee: Rep Fitness LLC, Westminster, CO (US)

( * ) Notice: Subject to any disclaimer, the term of this patent is extended or adjusted under 35 U.S.C. 154(b) by 0 days.

(21) Appl. No.: 19/115,549

(22) PCT Filed: Sep. 28, 2023

(86) PCT No.: PCT/US2023/075350
§ 371 (c)(1),
(2) Date: Mar. 26, 2025

(87) PCT Pub. No.: WO2024/073555
PCT Pub. Date: Apr. 4, 2024

(65) Prior Publication Data

US 2025/0256149 A1 Aug. 14, 2025

Related U.S. Application Data

(60) Provisional application No. 63/410,670, filed on Sep. 28, 2022.

(51) Int. Cl.
*A63B 21/08* (2006.01)
*A63B 21/00* (2006.01)
*A63B 21/06* (2006.01)

(52) U.S. Cl.
CPC ..... *A63B 21/08* (2013.01); *A63B 21/0615* (2013.01); *A63B 21/4035* (2015.10); *A63B 21/4049* (2015.10)

(58) Field of Classification Search
CPC .... A63B 21/078; A63B 21/0615–0617; A63B 21/08; A63B 21/4035;
(Continued)

(56) References Cited

U.S. PATENT DOCUMENTS 827,233 A 7/1906 Gould
4,355,746 A * 10/1982 Casady ..... A63B 55/57 211/100
(Continued)

FOREIGN PATENT DOCUMENTS

AU 2019231690 B2 7/2022
EP 3762111 A1 1/2021
(Continued)

OTHER PUBLICATIONS

PCT Patent Application No. PCT/US23/75350, filed Sep. 28, 2023. First named inventor: Larson. Written Opinion of the International Searching Authority dated Jan. 31, 2024. 4 pages.
(Continued)

*Primary Examiner* — Megan Anderson
*Assistant Examiner* — Kathleen M Fisk
(74) *Attorney, Agent, or Firm* — NOD Law PC

(57) ABSTRACT

A trolley assembly for a weight arm includes first and second trolley members that capture a vertical member of a weight rack and is selectively slidable. An arm bracket is configured to rotatably support the weight arm and the arm bracket is pivotably coupled to the trolley members about a pivot point. The pivot point defines a pivot axis that is orthogonal to the longitudinal axis. Additionally, a position lock assembly includes an engagement pin supported on the arm bracket remote from the pivot point and a guide plate defining two or more pin receivers. The position lock assembly defines a pivot angle of the arm bracket around the pivot axis relative to the trolley members.

20 Claims, 10 Drawing Sheets

(58) Field of Classification Search
CPC ..... A63B 21/4047; A63B 21/4049; A63B 21/159; A63B 23/1218
See application file for complete search history.

(56) References Cited

U.S. PATENT DOCUMENTS

| | | | | |
|---|---|---|---|---|
| 5,570,957 | A | 11/1996 | Kuly et al. | |
| 6,238,323 | B1 * | 5/2001 | Simonson | A63B 21/0628 482/102 |
| 6,488,612 | B2 * | 12/2002 | Sechrest | A63B 21/152 482/138 |
| 7,476,184 | B1 * | 1/2009 | Batca | A63B 21/4047 482/133 |
| 7,641,602 | B2 | 1/2010 | Rogers et al. | |
| 7,815,552 | B2 | 10/2010 | Dibble et al. | |
| 7,918,771 | B2 | 4/2011 | Rogers et al. | |
| 8,147,390 | B2 | 4/2012 | Rogers et al. | |
| 8,257,233 | B2 | 9/2012 | Rogers et al. | |
| 8,491,449 | B2 | 7/2013 | Rogers et al. | |
| 8,657,726 | B2 | 2/2014 | Rogers et al. | |
| 8,852,032 | B1 | 10/2014 | Barnes | |
| 9,421,413 | B2 | 8/2016 | Staten et al. | |
| 10,010,740 | B2 * | 7/2018 | Hockridge | A63B 21/0628 |
| 10,646,744 | B2 | 5/2020 | Steenekamp et al. | |
| D890,271 | S | 7/2020 | Carmichael et al. | |
| D890,867 | S | 7/2020 | Carmichael et al. | |
| D892,239 | S | 8/2020 | Carmichael et al. | |
| D898,136 | S | 10/2020 | Carmichael et al. | |
| D898,137 | S | 10/2020 | Carmichael et al. | |
| 10,799,749 | B2 | 10/2020 | Sorin | |
| 11,103,738 | B2 | 8/2021 | Sorin et al. | |
| 11,117,015 | B2 | 9/2021 | Steenekamp et al. | |
| 11,173,337 | B2 * | 11/2021 | Jones | A63B 21/4035 |
| D954,864 | S | 6/2022 | Carmichael et al. | |
| D954,867 | S | 6/2022 | Carmichael et al. | |
| D955,511 | S | 6/2022 | Carmichael et al. | |
| 11,517,785 | B1 * | 12/2022 | Nolan | A63B 17/04 |
| 2007/0054785 | A1 | 3/2007 | Drechsler | |
| 2007/0155595 | A1 | 7/2007 | Rogers et al. | |
| 2007/0155596 | A1 | 7/2007 | Rogers et al. | |
| 2011/0136632 | A1 | 6/2011 | Rogers et al. | |
| 2012/0165164 | A1 | 6/2012 | Rogers et al. | |
| 2012/0283075 | A1 | 11/2012 | Rogers et al. | |
| 2013/0281268 | A1 | 10/2013 | Rogers et al. | |
| 2013/0296146 | A1 | 11/2013 | Staten et al. | |
| 2018/0200563 | A1 | 7/2018 | Hansen et al. | |
| 2019/0201734 | A1 | 7/2019 | Sorin | |
| 2019/0269963 | A1 | 9/2019 | Steenekamp et al. | |
| 2019/0275363 | A1 | 9/2019 | Jones et al. | |
| 2020/0139186 | A1 | 5/2020 | Sorin et al. | |
| 2020/0298051 | A1 | 9/2020 | Steenekamp et al. | |
| 2021/0379438 | A1 | 12/2021 | Sorin et al. | |
| 2022/0096893 | A1 | 3/2022 | Steenekamp et al. | |
| 2022/0105380 | A1 | 4/2022 | Jones et al. | |
| 2022/0323815 | A1 * | 10/2022 | Simental | A63B 21/0557 |

FOREIGN PATENT DOCUMENTS

| | | | |
|---|---|---|---|
| WO | 2007/030251 | A2 | 3/2007 |
| WO | 2018/208772 | A1 | 11/2018 |
| WO | 2019/136144 | A1 | 7/2019 |
| WO | 2019/173517 | A1 | 9/2019 |

OTHER PUBLICATIONS

PCT Patent Application No. PCT/US23/75350, filed Sep. 28, 2023. First named inventor: Larson. International Search Report dated Jan. 31, 2024. 9 pages.

Extended European Search Report and Search Opinion received for EP Application No. 23873912.2, mailed on Dec. 16, 2025, 12 pages.

* cited by examiner

TROLLEY ASSEMBLY AND WEIGHT ARM

CROSS REFERENCE TO RELATED APPLICATIONS

This application is a United States National Phase under 35 U.S.C. § 371 of PCT patent application no. PCT/US23/75350 filed 28 Sep. 2023 entitled "TROLLEY ASSEMBLY AND WEIGHT ARM", which claims the benefit of priority under 35 U.S.C. $119 of U.S. provisional application No. 63/410,670 filed 28 Sep. 2022 entitled "Trolley assembly, weight arm assembly, and weight rack," each of which are hereby incorporated by reference herein in their entireties and for all purposes.

INTRODUCTION

Power weight racks are pieces of fitness equipment most often used for barbell exercises such as squats, deadlifts, and bench presses. Generally, the power weight racks are a cage of metal bars that surrounds the lifter. Additionally, attachments can be used on the power weight racks to add additional functionality to the power weight racks. Weight arms are one type of such attachments. Weight arms are typically plate-loaded arms that couple to vertical members of the power weight racks. A weight arm may be fixed in position to a vertical member or a trolley assembly may be used to allow the weight arm to be slidingly positionable along the length of the vertical member. A weight arm may be rotatable within a plane around a pivot point or be locked in place for static moves, like dips and pull-ups. A pair of weight arms can be used independently for unilateral movements or together.

SUMMARY

In one example implementation, the technology relates to a trolley assembly for a weight arm, the trolley assembly including a first trolley member configured to be disposed on a first side of a vertical member of a weight rack, the vertical member defining a longitudinal axis; a second trolley member configured to be disposed on an opposite, second side of the vertical member of the weight rack, the first trolley member couplable to the second trolley member to capture the vertical member of the weight rack therebetween, the trolley assembly being selectively slidable along the longitudinal axis; and an arm bracket further configured to rotatably support the weight arm about a first pivot axis axially transverse to the longitudinal axis and in a plane parallel to the first side of the vertical member; and pivotably coupled to the second trolley member about a second pivot axis that is orthogonal to both the longitudinal axis and the first pivot axis.

In an example, the second pivot axis does not intersect with the first pivot axis. In another example, the second pivot axis is located below the first pivot axis with respect to the longitudinal axis of the vertical member. In yet another example, the trolley assembly further includes a position lock assembly including an engagement pin supported on the arm bracket and spaced apart from the second pivot axis; and a guide plate coupled to the second trolley member, the guide plate defining two or more pin receivers, wherein the position lock assembly is positionable in at least a first configuration and a second configuration, such that in the first configuration, the engagement pin engages with a first pin receiver to define a first pivot angle of the arm bracket around the second pivot axis relative to the longitudinal axis of the vertical member, and in the second configuration, the engagement pin engages with a second pin receiver to define a second pivot angle of the arm bracket around the second pivot axis relative to the longitudinal axis of the vertical member and the second pivot angle is different than the first pivot angle. In still another example, the position lock assembly is also positionable in a third configuration such that the engagement pin disengages with the two or more pin receivers and the arm bracket is pivotable around the second pivot axis between at least the first pivot angle and the second pivot angle. In an example, the position lock assembly further includes a guide pin extending from the arm bracket; the guide plate further defines an arcuate channel receiving at least a portion of the guide pin; and the arcuate channel defines pivot limits of the arm bracket around the second pivot axis.

In another example, the pivot limits of the arm bracket are +/−20° from a center position that is parallel to the longitudinal axis. In yet another example, the engagement pin is spring loaded and biased towards an engaged position with the guide plate. In still another example, the trolley assembly further includes an adjustment pin supported on the first trolley member and selectively engageable with the vertical member of the weight rack to lock a position of the trolley assembly along the longitudinal axis. In an example, the trolley assembly further includes at least one handle coupled to the first trolley member. In another example, the adjustment pin includes a lever disposed within the at least one handle, connected to the adjustment pin, and operable to engage and disengage the adjustment pin with the vertical member of the weight rack. In yet another example, the first trolley member and the second trolley member each include at least one roller positionable against the vertical member of the weight rack.

In another example implementation, the technology relates to a weight arm assembly for a weight rack, the weight arm assembly including a trolley assembly configured to couple to a vertical member of the weight rack, the vertical member defining a longitudinal axis and the trolley assembly being selectively slidable along the longitudinal axis on the vertical member, the trolley assembly including a first trolley member configured to be disposed on a first side of the vertical member of the weight rack; a second trolley member configured to be disposed on an opposite, second side of the vertical member of the weight rack, the first trolley member couplable to the second trolley member to capture the vertical member of the weight rack therebetween; an arm bracket pivotably coupled to the second trolley member about a pivot point, the pivot point defining a pivot axis that is orthogonal to the longitudinal axis; and a weight arm rotatably coupled at a first end to the arm bracket around a rotation axis orthogonal to both the longitudinal axis and the pivot axis and configured to couple to a weight bar member.

In an example, the pivot axis does not intersect with the rotation axis. In another example, the pivot axis is located below the rotation axis with respect to the longitudinal axis of the vertical member. In yet another example, the weight arm assembly further includes an engagement pin supported on the arm bracket spatially apart from the pivot point; and a guide plate coupled to the second trolley member and defining two or more pin receivers, wherein the engagement pin is selectively engageable within a respective pin receiver of the two or more pin receivers to define a respective pivot angle of the arm bracket relative to the second trolley member, and the weight arm is rotatable around the rotation axis at each respective pivot angle of the arm bracket. In still another example, the arm bracket is substantially U-shaped with two side plates and a base plate; the base plate is pivotably coupled to the second trolley member; and the weight arm is rotatably coupled between the two side plates. In an example, the arm bracket further includes a weight arm pin; the two side plates each define a plurality of apertures spaced apart relative to the rotation axis; and the weight arm is selectively positionable about the rotation axis relative to the arm bracket via engagement between the weight arm pin and the plurality of apertures.

In another example, a stop plate extends within the arm bracket, the stop plate at least partially defining a parallel orientation of the weight arm relative to the vertical member of the weight rack. In yet another example, the weight arm assembly further includes an adjustment pin supported on the first trolley member and selectively engageable with the vertical member of the weight rack to lock a position of the trolley assembly along the longitudinal axis.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. The details of one or more examples are set forth in the accompanying drawings and the description below. Other features, objects, and advantages of these examples will be apparent from the description, drawings, and claims. Moreover, it is to be understood that both the foregoing summary of the disclosure and the following detailed description are exemplary and intended to provide further explanation without limiting the scope of the disclosure.

BRIEF DESCRIPTION OF THE DRAWINGS

The following drawing figures, which form a part of this application, are illustrative of described technology and are not meant to limit the scope of the disclosure as claimed in any manner, which scope shall be based on the claims appended hereto.

The use of cross-hatching in the accompanying figures is generally provided to indicate a surface of a cross-section cut. The use of contour lines, shading, or stippling in the accompanying figures is generally provided indicate surface features, including curved surfaces or changes in depth, to clarify boundaries between adjacent elements, and to facilitate legibility of the figures. Accordingly, neither the presence nor the absence of cross-hatching, contour lines, shading, or stippling conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various example embodiments described herein and, accordingly, may not necessarily be presented or illustrated to scale, and are not intended to indicate any preference or requirement for an illustrated embodiment to the exclusion of embodiments described with reference thereto.

Figure 1:
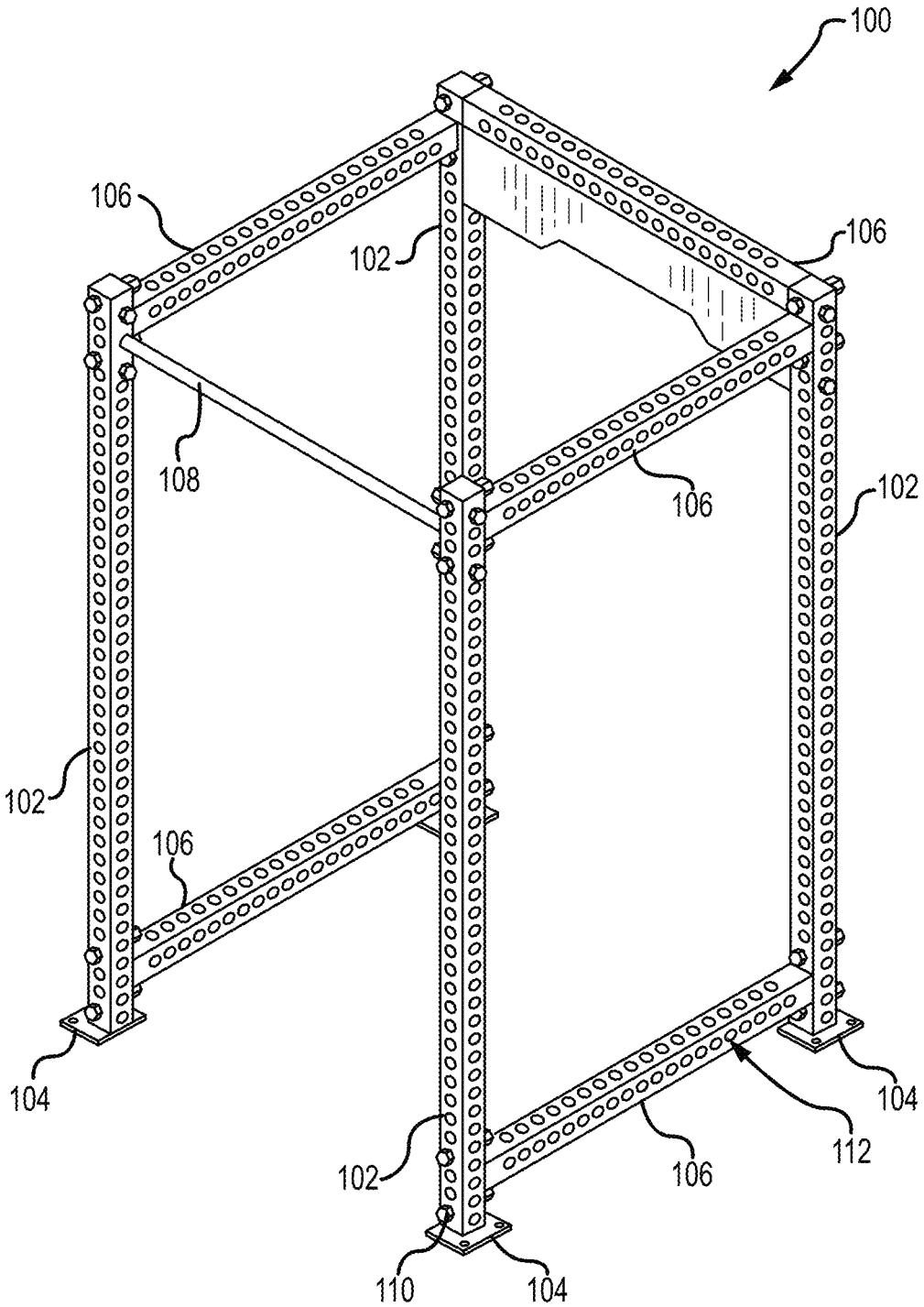

FIG. 1 depicts an isometric view of an exemplary weight rack.

Figure 2:
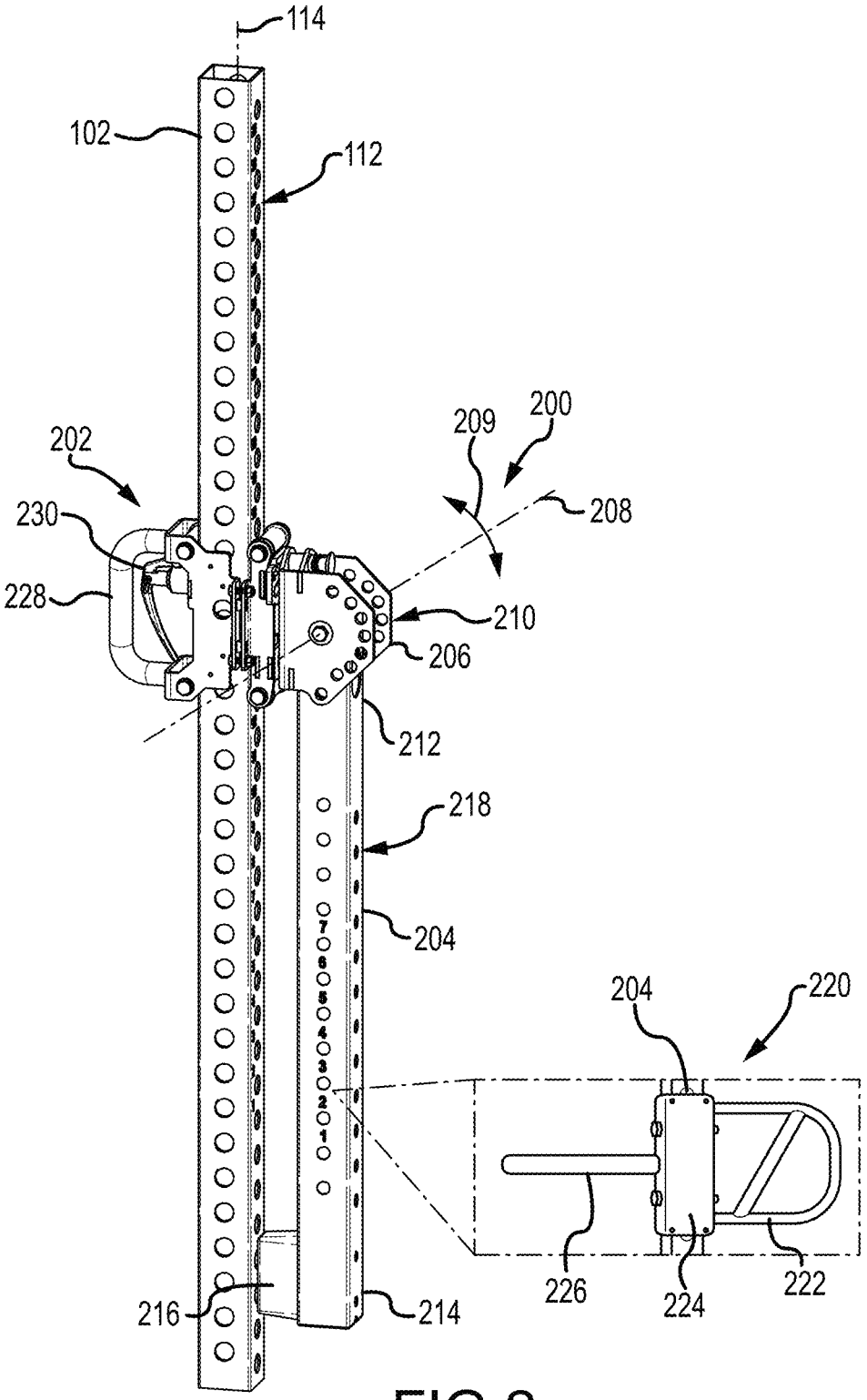

FIG. 2 depicts an isometric view of a weight arm assembly coupled to a vertical member of the weight rack shown in FIG. 1.

Figure 3:
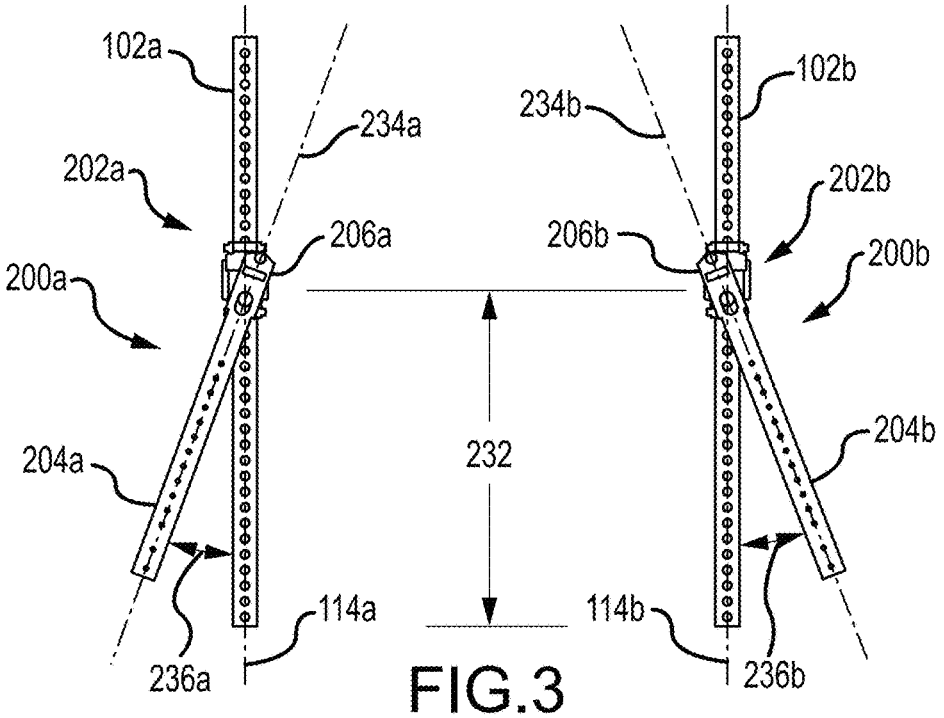

FIG. 3 depicts a pair of weight arm assemblies attached to vertical members of a weight rack in a downward position.

Figure 4:
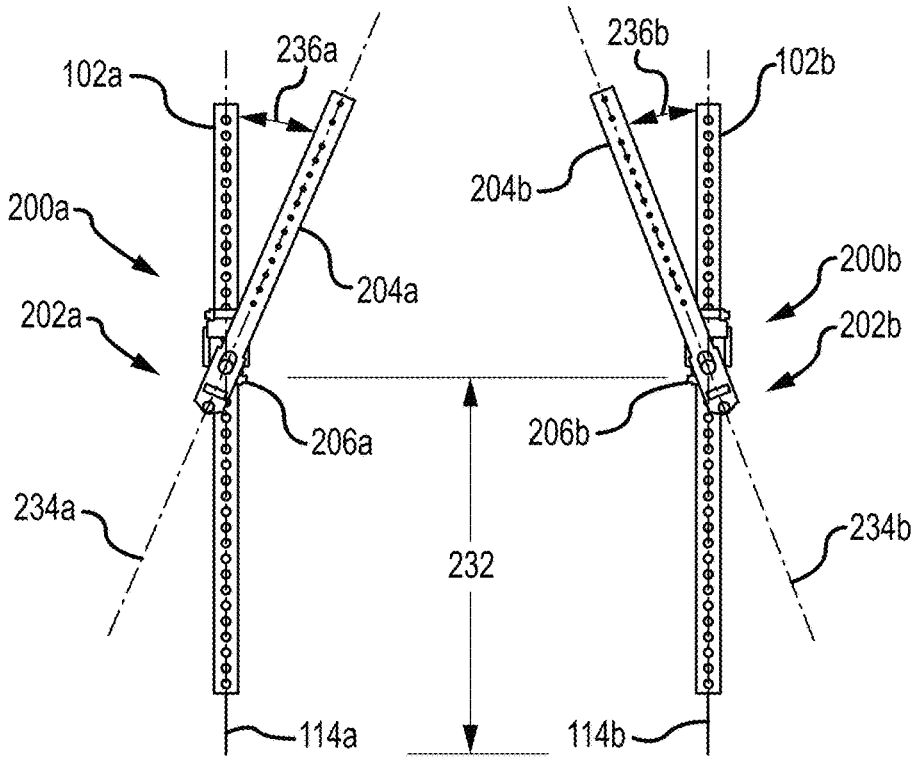

FIG. 4 depicts the pair of weight arm assemblies attached to vertical members of a weight rack in an upward position.

Figure 5:
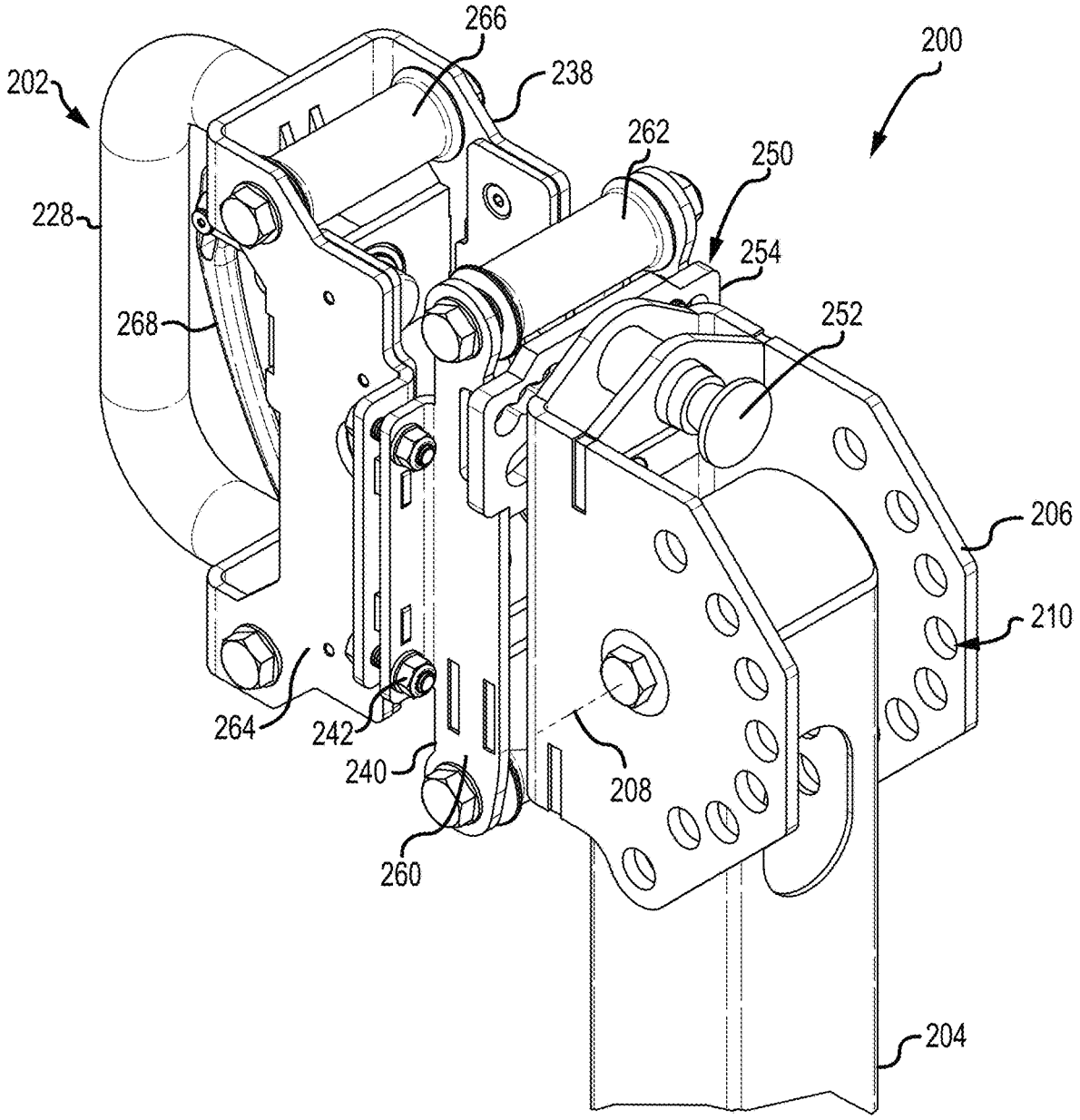

FIG. 5 depicts an isometric view of a portion of the weight arm assembly shown in FIG. 2.

Figure 6:
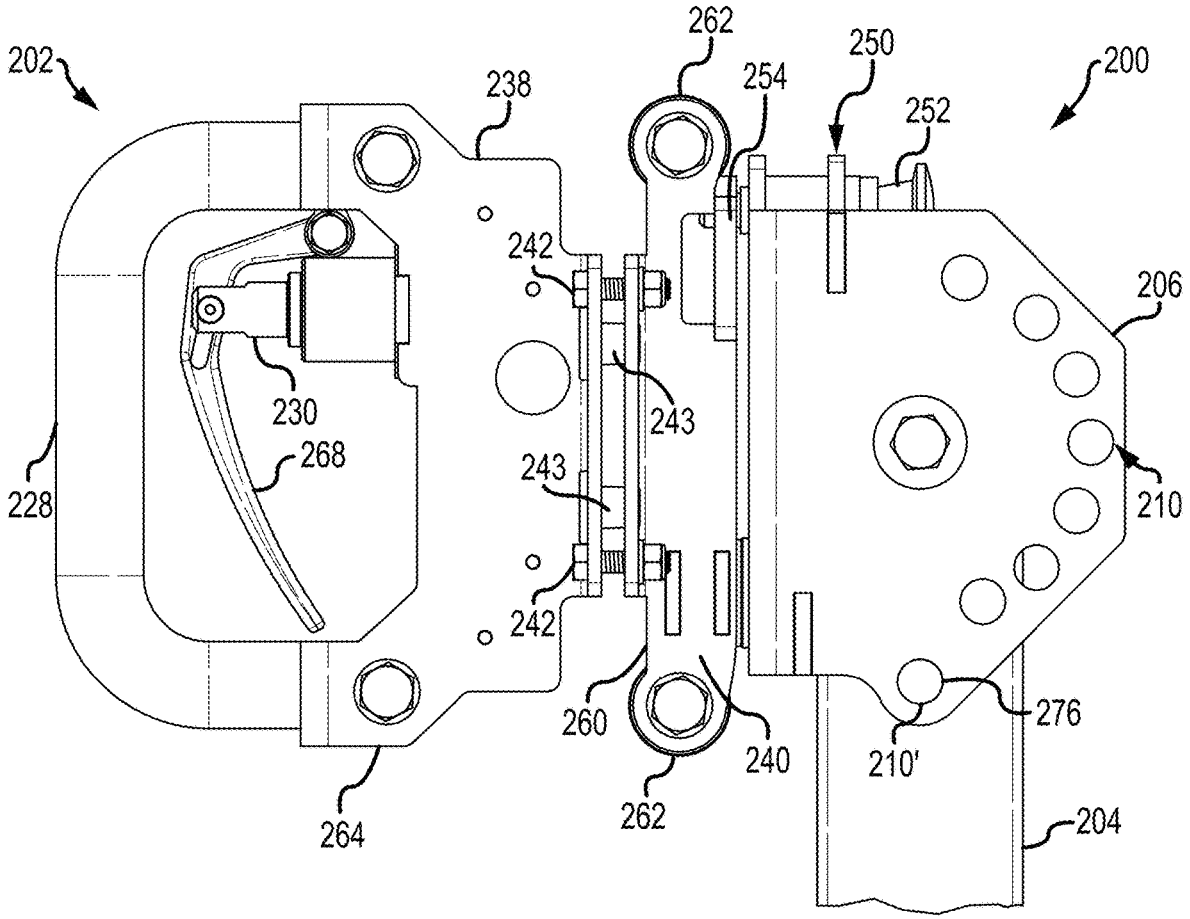

FIG. 6 depicts a side elevation view of the portion of the weight arm assembly shown in FIG. 5.

Figure 7:
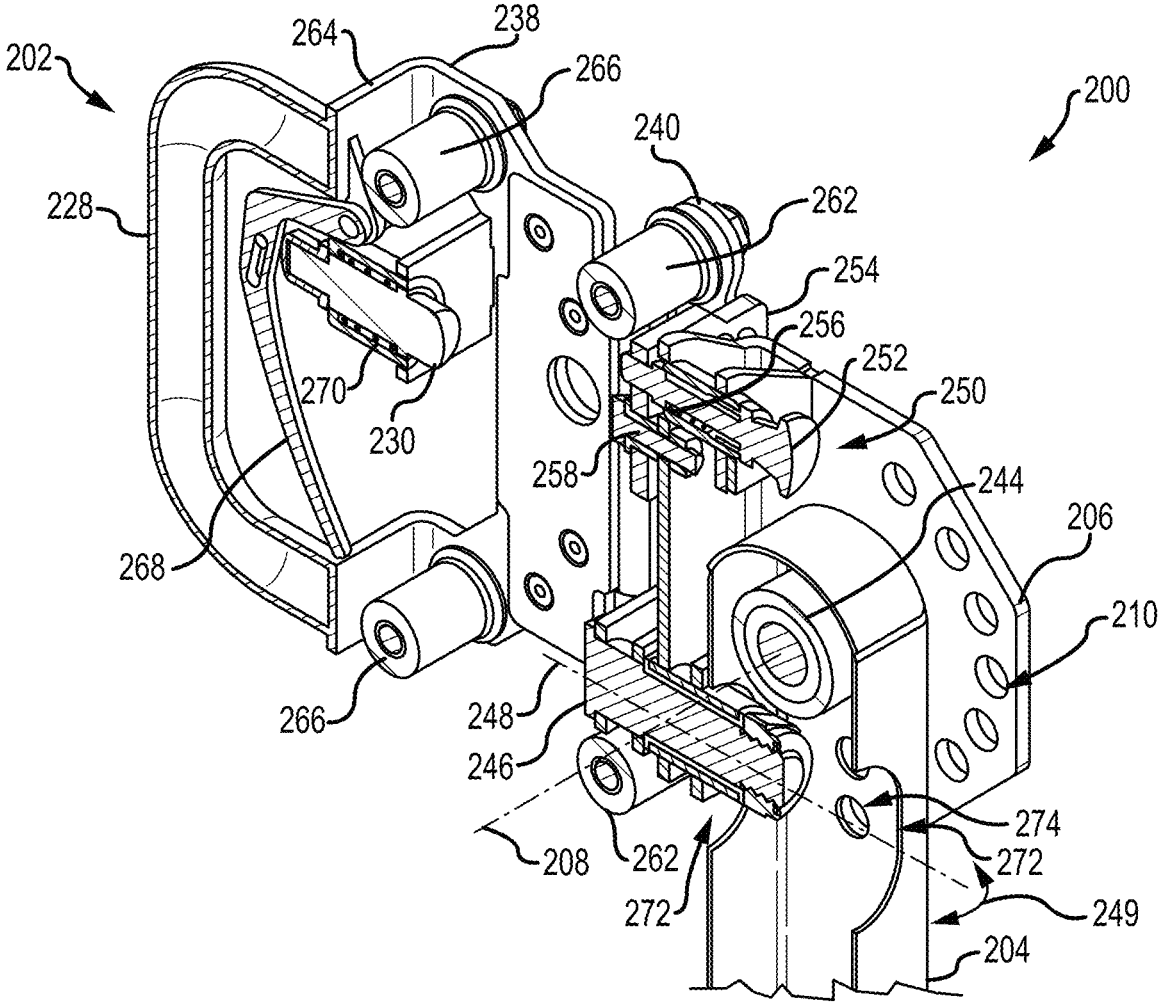

FIG. 7 depicts an isometric view in cross section of the portion of the weight arm assembly shown in FIG. 5.

Figure 8:
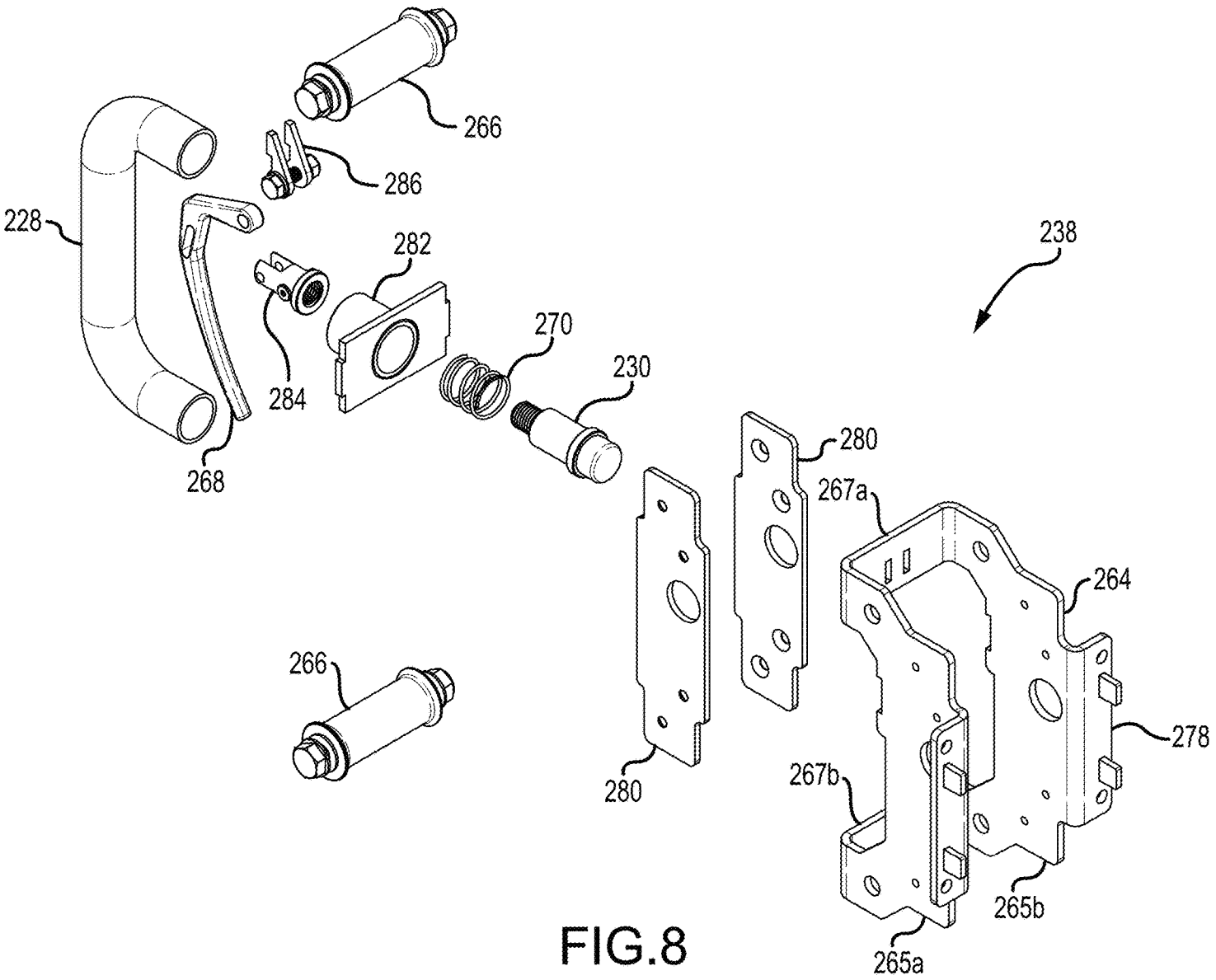

FIG. 8 depicts an exploded isometric view of a first trolley member of the weight arm assembly shown in FIG. 2.

Figure 9:
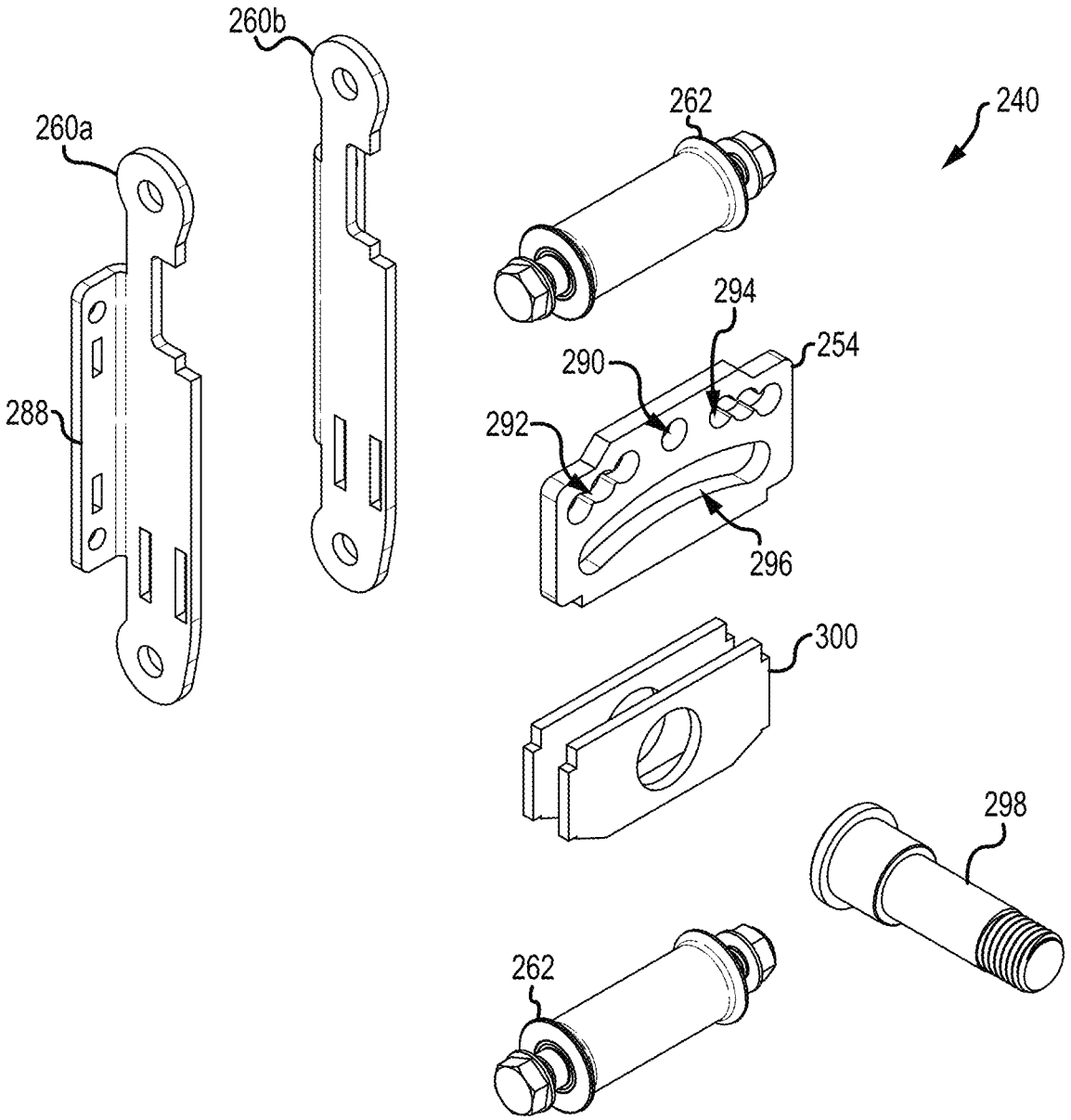

FIG. 9 depicts an exploded isometric view of a second trolley member of the weight arm assembly shown in FIG. 2.

Figure 10:
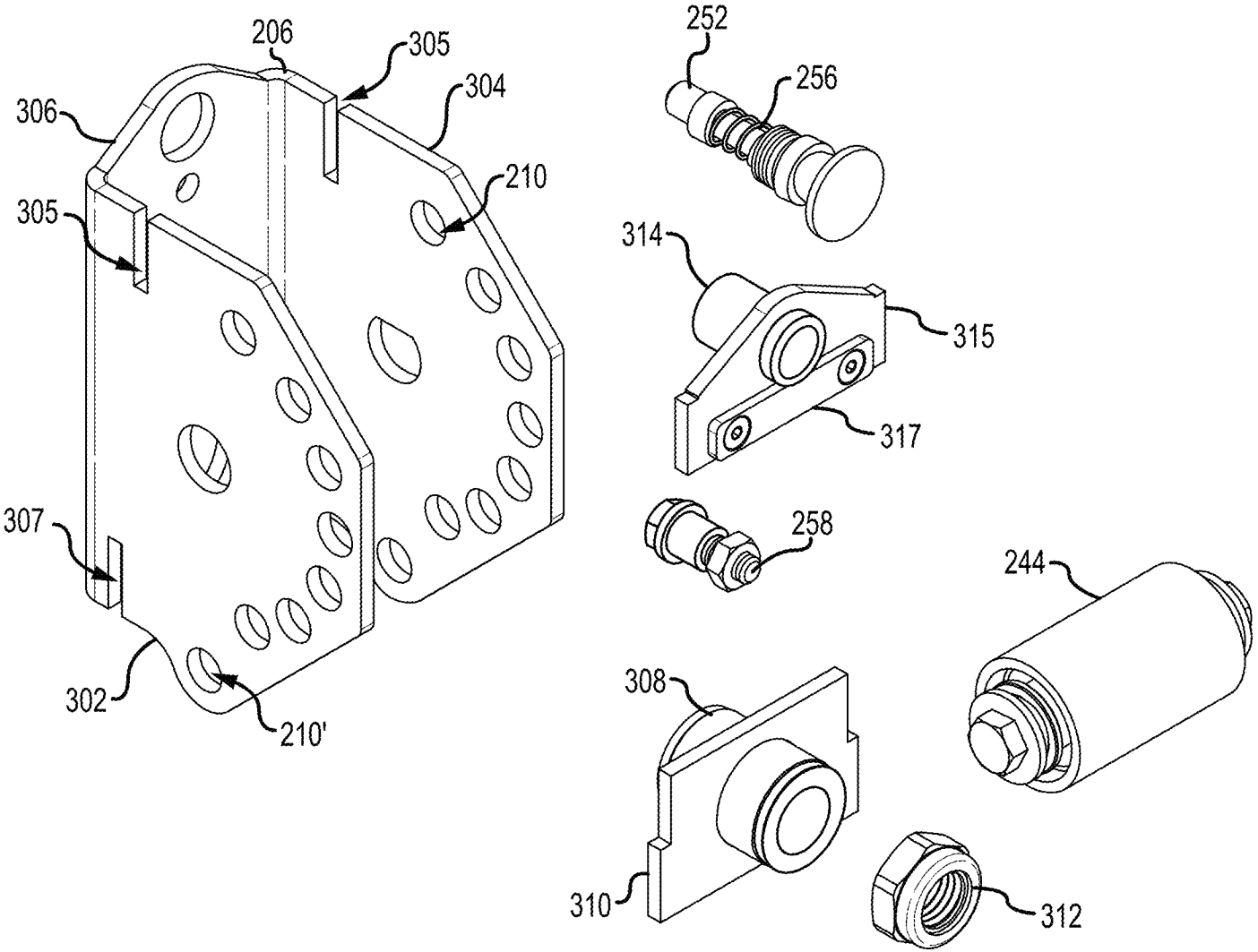

FIG. 10 depicts an exploded isometric view of an arm bracket of the weight arm assembly shown in FIG. 2.

Figure 11:
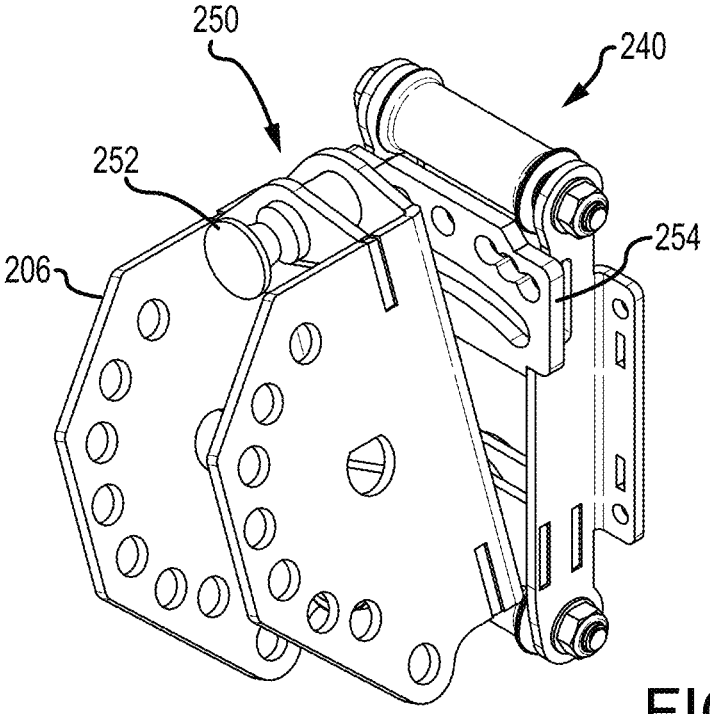
Figure 12:
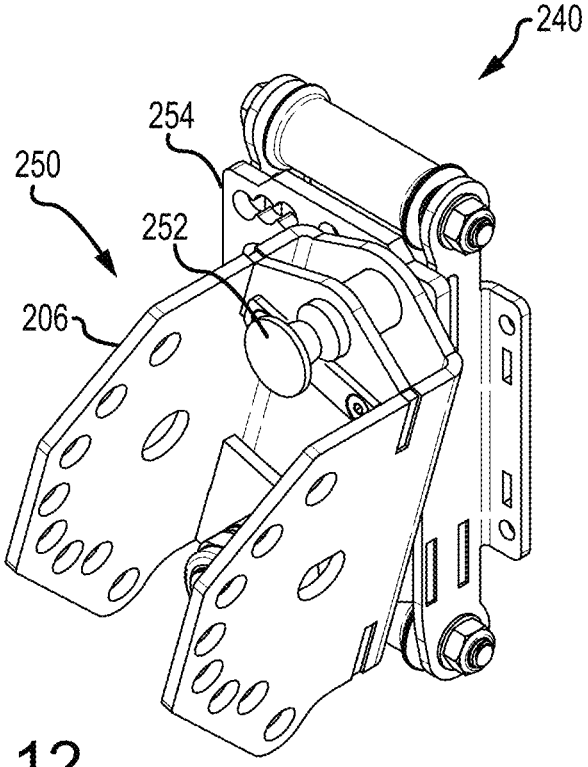

FIGS. 11 and 12 illustrate different pivot angle positions of the arm bracket relative to the second trolley member.

DETAILED DESCRIPTION

Examples of the present technology are directed to a power weight rack and the attachment of rotatable weight arms. The weight arms are configured to receive weight plates so that users can perform any number of exercises such as rows, deadlifts, squats, a variety of presses, belt squats, etc. Additionally, the weight arms can be locked in place for exercises like dips, L-sits, pull-ups, etc. A trolley assembly is used to attach a respective weight arm to the power weight rack. The trolley assembly is configured to slide along a vertical member of the power weight rack and selectively engage with the vertical member to set and lock the height of the corresponding weight arm. The weight arm is rotatably coupled to the trolley assembly via an intermediate arm bracket. The weight arm can rotate about a rotational axis in an up-down orientation (e.g., along a vertical path) for some exercises or the weight arm can be locked in a fixed position with respect to the arm bracket for other exercises. Additionally, the arm bracket is pivotably coupled to the trolley assembly about a pivot axis that extends substantially in a horizontal direction away from the vertical member to which the trolley assembly is secured. In this configuration, the pivot axis of the arm bracket is orthogonal to both a longitudinal axis of the vertical member and the rotational axis of the weight arm. This coupling enables the weight arm to have an adjustable pivot angle and allow the weight arms to swing in angular paths that are different than along the vertical path described above. A position lock assembly is provided so that a pivot angle position of the arm bracket can be locked into place during such exercises.

FIG. 1 depicts an isometric view of an exemplary weight rack 100. In the example, the weight rack 100 may be a power rack configured for barbell use. In other examples, the weight rack 100 may be a squat rack configured for squats. The weight rack 100 is formed as a cage having a plurality of vertical members 102 (e.g., four vertical members). At the bottom of the vertical members 102, feet 104 are provided so that the weight rack 100 stands upright on an underlying surface. A plurality of cross-bars 106 are coupled between two vertical members 102 so as to form the cage-like shape. In the example, a pair of top and bottom cross-bars extend between both the left and right vertical member pairs.

Additionally, a top cross-bar may couple between the rear left and right vertical members 102. A pull-up bar 108 can couple between the forward left and right vertical members at the top. The cross-bars 106 and pull-up bar 108 may attach to the vertical members 102 via fasteners 110 (e.g., bolts). It should be appreciated that one of skill in the art would understand that weight racks 100 can take many different configurations and have any number of modifications and/or additions thereto. The trolley and weight arm assemblies described in detail below are configured to be mounted on the vertical member 102, and as such, the weight rack 100 used herein includes at least one vertical member 102.

In the example, the vertical members 102 and the cross-bars 106 may be formed out of square steel tube, e.g., in some implementations, 3 inch by 3 inch 11-gauge steel. A plurality of holes 112 are formed within each of the vertical members 102 and the cross-bars 106 to facilitate attachments thereto. In an example implementation, the hole 112 size may be about 1 inch and have a 2-inch spacing along a vertical member 102 or cross-bar 106. The height of the vertical members 102 can be sized as required or desired and, for example, may be 80 inches or 93 inches. In an example implementation, the width between the left and right vertical members 102 may be about 51 inches. The depth between the forward and rearward vertical member 102 may be 16 inches, 30 inches, or 41 inches, in some example implementations, as required or desired. These dimensions of the weight rack 100 are provided as examples only, and the height, width, and depth dimensions can be set to any length as required or desired.

FIG. 2 depicts a perspective view of a weight arm assembly 200 coupled to the vertical member 102 of the weight rack 100 (shown in FIG. 1). The vertical member 102 defines a longitudinal axis 114 that extends in a vertical direction and that the holes 112 are spaced along. The vertical member 102 is presented as transparent in FIG. 2 for illustrative purposes. The weight arm assembly 200 is coupled to the vertical member 102 and is slidable along the longitudinal axis 114 so that the weight arm assembly 200 is selectively positionable along the vertical member 102. The weight arm assembly 200 includes a trolley assembly 202 that couples to the vertical member 102 and a weight arm 204 that is rotatably mounted to an arm bracket 206 of the trolley assembly 202. The weight arm 204 is rotatable around a rotation axis 208 that is substantially orthogonal (but offset) to the longitudinal axis 114. In the example, the weight arm 204 may be rotatable along an arc 209 approximately 180° around the rotation axis 208 for various exercises as required or desired. Additionally, the arm bracket 206 includes a plurality of apertures 210 that allows the weight arm 204 to be locked into place in one or more rotational positions along the arc relative to the rotation axis 208 or to allow for different starting positions for the weight arm 204. As shown in FIG. 2, the weight arm 204 is substantially parallel to the vertical member 102 and in a downwards position. Such a downward position is typical when the weight arm 204 is not in use (e.g., being pivoted by a user for storage).

The weight arm 204 includes a first end 212 that rotatably couples to the arm bracket 206 and an opposite second end 214 that is configured to rotate around the rotation axis 208. In the example, the second end 214 may include a bumper 216 for when the weight arm 204 is in the downwards position. The weight arm 204 includes a plurality of holes 218 defined therein and spaced between the first and second ends 212, 214. A weight bar member 220 is configured to attach to the weight arm 204 via the holes 218. The weight bar member 220 is shown as separated in FIG. 2 for clarity. In an example implementation, at least some of the holes 218 may include indicia to assist in placement of attachments such as the weight bar member 220. The weight bar member 220 includes a handle 222, a bracket 224, and a weight bar 226. The bracket 224 is configured to at least partially receive the weight arm 204 and secure thereto with fasteners (e.g., bolts extending through the holes 218). It is appreciated that other attachment members (e.g., a leg roller attachment—not shown) may be used with the weight arm 204 as required or desired.

The trolley assembly 202 can include a handle 228 and an adjustment pin 230. The adjustment pin 230 selectively engages with the holes 112 within the vertical member 102 to define the position of the weight arm assembly 200 along the longitudinal axis 114. For example, when the adjustment pin 230 is engaged with the vertical member 102, the position of the trolley assembly 202 is fixed relative to the vertical member 102, and when the adjustment pin 230 is disengaged with the vertical member 102, the trolley assembly 202 is allowed to slide along the longitudinal axis 114 for repositioning.

While FIG. 2 illustrates a single weight arm assembly 200 coupled to the vertical member 102, it should be appreciated that a pair of weight arm assemblies 200 are often used together and mounted on the weight rack 100. For example, the weight arm assembly 200 is mounted to each of the front left and right vertical members 102 for use and as illustrated in FIGS. 3 and 4. Each weight arm assembly 200 can thus be used individually or in combination as required or desired. Further, although the trolley assembly 202 is depicted as configured to moveably position the weight arm assembly 200 slidably along the vertical member 102, other configurations contemplate a weight arm assembly 200 secured relative to the vertical member 102 either fixedly or via different moveable structures, as known in the art. For example, a trolley assembly may be configured to couple to the vertical member 102, but not be slidable, and still include the pivoting structure as described further below.

In operation, the user may load weight plates (not shown) on the weight bar 226 and then, because of the free rotation of the weight arm 204 around the rotation axis 208, perform any number of exercises, such as, but not limited to, rows, deadlifts, squats, a variety of presses, belt squats, hip/glute thrusts (with leg roller attachment), monolift bench presses, banded jumps, etc. When the weight arm 204 is rotating 209 around the rotation axis 208, the weight arm 204 moves in a defined plane that is orthogonal to the rotation axis 208. As illustrated in FIG. 2, the plane that the weight arm 204 moves within extends along the longitudinal axis 114 because the rotation axis 208 is substantially orthogonal (but offset) to the longitudinal axis 114. For some exercises, it is desirable to change the angle of the plane in which the weight arm 204 rotates. As such, and as described further below, the arm bracket 206 is selectively positionable around a pivot axis that is substantially orthogonal to both the longitudinal axis 114 and the rotation axis 208. This allows for the further modification of the exercises as required or desired. Additionally, the user may lock the weight arm 204 in place for exercises like dips, L-sits, pull-up and pull-up variations, etc. Even when the weight arm 204 is locked in place, it may be desirable to change the angle of the plane that the weight arm 204 extends within.

FIG. 3 depicts a pair of weight arm assemblies 200*a*, 200*b* in a downward position. FIG. 4 depicts the pair of weight arm assemblies 200*a*, 200*b* in an upward position. Referring concurrently to FIGS. 3 and 4, left and right vertical members 102*a*, 102*b* are illustrated with left and right weight arm assemblies 200*a*, 200*b* positioned thereon and at a height 232 relative to the underlying surface. As illustrated, the left arm bracket 206*a* of the left trolley assembly 202*a* is pivoted so that the left weight arm 204*a* is positioned outward relative to the left vertical member 102*a* in the downward position and positioned inward relative to the left vertical member 102*a* in the upward position. A plane 234*a* that the left weight arm 204*a* moves within is thus defined by a pivot angle 236*a* relative to the left longitudinal axis 114*a*. The angle 236*a* is the same in both the downward and upward positions, but mirrored relative to the height 232 of the left weight arm assembly 200*a* and on opposite sides of the left vertical member 102*a*.

Similarly, the right arm bracket 206*b* of the right trolley assembly 202*b* is pivoted so that the right weight arm 204*b* is positioned outward relative to the right vertical member 102*b* in the downward position and positioned inward relative to the right vertical member 102*b* in the upward position. A plane 234*b* that the right weight arm 204*b* moves within is thus defined by a pivot angle 236*b* relative to the right longitudinal axis 114*b*. The angle 236*b* is the same in both the downward and upward positions, but mirrored relative to the height 232 of the right weight arm assembly 200*b* and on opposite sides of the right vertical member 102*b*.

In the example, the plane 234 that the weight arm 204 rotates within may be parallel to the longitudinal axis 114 and as illustrated in FIG. 2, or the plane 234 may be non-parallel to the longitudinal axis 114 and as illustrated in FIGS. 3 and 4. The pivot angle 236 of the weight arm 204 may be up to and including +/−20°, or greater, relative to the longitudinal axis 114. As illustrated in FIGS. 3 and 4, the left and right weight arms 204*a*, 204*b* are pivoted in opposite directions, and thus, are independently pivotable relative to each other. At each pivot angle 236 of the weight arm 204, including a centered positions illustrated in FIG. 2, the weight arm 204 is rotatable around the rotation axis 208 (shown in FIG. 2). In other examples, the weight arm 204 may be locked in position relative to the rotation axis 208 at each pivot angle 236.

FIG. 5 depicts a partial isometric view of the weight arm assembly 200. FIG. 6 depicts a side elevation view of the weight arm assembly 200. FIG. 7 depicts an isometric view in cross-section of the weight arm assembly 200. Referring concurrently to FIGS. 5-7, the weight arm assembly 200 includes the weight arm 204 rotatably mounted to the trolley assembly 202. The trolley assembly 202 includes a first trolley member 238 configured to be disposed on a first side of the vertical member 102 (shown in FIG. 2) and a second trolley member 240 configured to be disposed on an opposite, second side of the vertical member 102. The trolley assembly 202 can also include the arm bracket 206. The first trolley member 238 couples to the second trolley member 240 to capture the vertical member 102 therebetween. Once the trolley assembly 202 is attached to the vertical member 102, the trolley assembly 202 is configured to slide along the longitudinal axis and be selectively secured in place via the adjustment pin 230. The first trolley member 238 is coupled to the second trolley member 240 via a plurality of fasteners 242 (e.g., bolt and nut) that are oriented substantially orthogonal (but offset) to the rotation axis 208 of the weight arm 204. Additionally, one or more alignment tabs 243 may be used to facilitate alignment between the first trolley member 238 and the second trolley member 240.

The arm bracket 206 is configured to rotatably support the weight arm 204 via a bearing 244, e.g., a hinge or sleeve bearing, that defines the rotation axis 208. The arm bracket 206 is pivotably coupled, e.g., via a sleeve bearing, to the second trolley member 240 at a pivot point 246. The pivot point 246 defines a pivot axis 248 that is substantially orthogonal to the longitudinal axis 114 of the vertical member 102. The pivot axis 248 is also substantially orthogonal (but offset) to the rotation axis 208. The pivot axis 248 may be parallel to the fasteners 242 that couple the first and second trolley members 238, 240 together. The pivoting 249 of the weight arm 204 and the arm bracket 206 is around the pivot axis 248 is described above in reference to FIGS. 3 and 4. The pivot axis 248 is substantially oriented in a horizontal direction. The pivot axis 248 may be positioned below the rotation axis 208 within the trolley assembly 202. The pivot axis 248 is not vertical, e.g., not parallel to the longitudinal axes 114 of the vertical members 102 and the trolley assembly 202 does not pivot in a vertical axis direction; rather, the trolley assembly 202 can slide relative to a vertical axis.

The pivot position of the arm bracket 206 around the pivot axis 248 can be releasably secured by a position lock assembly 250. The position lock assembly 250 includes an engagement pin 252 that is supported on the arm bracket 206 spatially offset from the pivot point 246 and a guide plate 254 coupled to the second trolley member 240. The engagement pin 252 is selectively engageable with the guide plate 254 to define the pivot angle 236 (shown in FIGS. 3 and 4) of the arm bracket 206 relative to the longitudinal axis 114 of the respective vertical member 102 and thus the pivot angle position of the weight arm 204.

For example, when the position lock assembly 250 is in a first configuration (e.g., as shown in FIGS. 5-7), the engagement pin 252 engages with the guide plate 254 to define the pivot angle 236 of the arm bracket 206 relative to the second trolley member 240. In this first configuration, the pivot angle 236 may be 0° relative to the longitudinal axis 114 and be substantially parallel thereto. The position lock assembly 250 is moveable to a second configuration (e.g., as shown in FIGS. 3 and 4), whereby the engagement pin 252 engages with a different area of the guide plate 254 to define a different pivot angle 236 of the arm bracket 206 relative to the second trolley member 240 and the longitudinal axis 114. Additionally, the position lock assembly 250 is also positionable in a third configuration (not shown), whereby the engagement pin 252 disengages with the guide plate 254 and allows the arm bracket 206 to freely pivot around the pivot axis 248 between at least two different pivot angles 236. In an example implementation, a distal end of the engagement pin 252 may include an enlarged or flanged head as a handle for the user to operate the position lock assembly 250.

In the example, a spring 256 biases the engagement pin 252 towards the guide plate 254 and towards an engaged position to lock the pivot angle 236 of the arm bracket 206. In an example implementation, the spring 256 is a compression spring. In operation, the user pulls on the head end of the engagement pin 252, overcoming the spring force, in order to withdraw and disengage the engagement pin 252 from the guide plate 254. Once released, the engagement pin 252 is biased back towards the engaged and extended position. The position lock assembly 250 can also include a guide pin 258 coupled to the arm bracket 206 and extending therefrom. The guide pin 258 slidably engages with the guide plate 254 to define the pivot limits of the arm bracket 206 around the pivot axis 248.

The second trolley member 240 is formed from a housing 260 that is disposed at least partially around the vertical member 102. The housing 260 supports a pair of top and bottom rollers 262 that are configured to roll against the side of the vertical member 102 when the trolley assembly 202 is being moved along the longitudinal axis. The first trolley member 238 is also formed from a housing 264 that is disposed at least partially around the vertical members. The housing 264 supports a pair of top and bottom rollers 266 that are configured to roll against the side of the vertical member 102. In an example implementation, the rollers 266 oppose the rollers 262 within the trolley assembly 202, and the rollers 262, 266 are substantially parallel to the rotation axis 208 of the weight arm 204. The handle 228 is coupled to the housing 264 and is positioned on the exterior of the housing 264. In the example, the handle 228 has a substantially circular cross-section that is formed in a U-shape. In an example implementation, the handle 228 is a single handle that is centered on the housing 264. In another example implementation, the top and bottom connection ends of the handle 228 are positioned adjacent to the top and bottom rollers 266.

The adjustment pin 230 is supported on the first trolley member 238. In an example implementation, the adjustment pin 230 is disposed at least partially within the handle 228. One end of the adjustment pin 230 is coupled to a lever 268 that is pivotably coupled to the housing 264. A spring 270 biases the adjustment pin 230 towards the vertical member 102 and toward an engaged position extending from the first trolley member 238. The adjustment pin 230 is configured to selectively engage (e.g., via extension therein) with the holes of the vertical member 102. In operation, a user pulls the lever 268 (e.g., in a direction toward the handle 228), to overcome the force of the spring 270 and retract the adjustment pin 230 so that the trolley assembly 202 can slide along the vertical member 102. In the example, a projection of the adjustment pin 230 slides within a channel defined within the lever 268 so that pivoting movement of the lever 268 translates into linear movement of the adjustment pin 230. Once the lever 268 is released, the adjustment pin 230 is biased back toward the engaged and extended position. In an example implementation, the adjustment pin 230, the engagement pin 252, and the guide pin 258, are all substantially parallel with each other and aligned with the pivot axis 248.

Turning to FIG. 7, the weight arm 204 includes a pair of opposing openings 272 disposed proximate to the bearing 244. The openings 272 are elongated along the length of the weight arm 204. When the weight arm 204 is positioned in its downward position, at least a portion of the pivot point 246 extends into the opening 272. This configuration enables the weight arm 204 to be positioned substantially parallel to the vertical member 102 when in the downward position. In an example, the illustrated downward position may correspond to a storage configuration and the openings 272 allow for the weight arm 204 to be positioned closer to the vertical member 102. Similarly, when the weight arm 204 is positioned in its upward position, at least a portion of the engagement pin 252 may extend into the opening 272 so that the weight arm 204 can be positioned substantially parallel to the vertical member 102. In an example implementation, the weight arm 204 is rotatable around the rotation axis 208 approximately 180°. In other example implementations, the weight arm 204 may be rotatable around the rotation axis 208 less than 180°, for example, about 175°, 170°, 165°, 160°, or less.

Additionally, the weight arm 204 includes at least one hole 274 (e.g., a pair of holes) that are on the sides of the weight arm 204 that do not include the openings 272 and are proximate to the bearing 244. The holes 274 are radially spaced from the bearing 244 and are configured to selectively align with the apertures 210 on the arm bracket 206. When a hole 274 and an aperture 210 align, a weight arm pin 276 (shown in FIG. 6) can be used to lock the rotational position of the weight arm 204 relative to the rotation axis 208. In the example, a pair of holes 274 are used because the apertures 210 may have different radial spacing from the rotation axis 208 as shown in FIG. 6. In the example implementation depicted, the downward position aperture 210' is radially different than the others. In other examples, the weight arm pin 276 may be coupled only to the arm bracket 206 and be used as a rotational stop for the freely rotatable weight arm 204. This configuration can reduce the angle of rotation of the weight arm 204 to angles that are less than 180°.

FIG. 8 depicts an exploded isometric view of the first trolley member 238 of the weight arm assembly 200 (shown in FIG. 2). The first trolley member 238 includes a housing 264 that supports a plurality of components. In the example, the housing 264 may have two parallel side plates 265*a*, 265*b* with top and bottom cross plates 267*a*, 267*b* extending therebetween. The side plates may have flanges 278 that are used to couple the first trolley member 238 to the second trolley member 240 via fasteners 242 and alignment tabs 243 (both shown in FIG. 6). A pair of liners 280 may couple to the inside of the parallel side plates 265*a*, 265*b* of the housing 264. Top and bottom rollers 266 also couple between the parallel side plates 265*a*, 265*b* of the housing 264. The handle 228 couples to the top and bottom cross plates 267*a*, 267*b* of the housing 264. A pin sleeve 282 couples to the housing 264 and slidably supports the adjustment pin 230 with the spring 270 disposed therein. An end cap 284 attaches to one end of the adjustment pin 230 and is used to couple the lever 268 that pivotably couples to the housing 264 via a lever bracket 286.

FIG. 9 depicts an exploded isometric view of the second trolley member 240 of the weight arm assembly 200 (shown in FIG. 2). The second trolley member 240 has the housing 260 that supports a plurality of components. In the example, the housing 260 may have two parallel side plates 260*a*, 260*b*. The side plates 260*a*, 260*b* may have flanges 288 that are used to couple the second trolley member 240 to the first trolley member 238 via fasteners 242 and alignment tabs 243 (both shown in FIG. 6). Top and bottom rollers 262 coupled between the parallel side plates 260*a*, 260*b*. The guide plate 254 is also coupled between the parallel side plates 260*a*, 260*b* proximate the top roller 262. The guide plate 254 defines two or more pin receivers. In this example, the guide plate 254 has a center pin receiver 290 and left and right pin receivers 292, 294. The left and right pin receivers 292, 294 may be formed as slots with a plurality of semicircular grooves formed within at least one side of the slot. In an example implementation, the left and right pin receivers 292, 294 are symmetrical relative to the center pin receiver 290.

The pin receivers 290, 292, 294 are configured to at least partially receive the engagement pin 252 of the position lock assembly 250 (both shown in FIG. 7) and lock the pivot angle of the arm bracket 206 (shown in FIG. 7) relative to the second trolley member 240. For example, when the engagement pin 252 engages with the center pin receiver 290, the arm bracket 206 is parallel to the longitudinal axis 114 of the vertical member 102. When the engagement pin 252 engages with one of the left and right pin receivers 292, 294 the arm bracket 206 is defined with a pivot angle 236 as shown in FIGS. 3 and 4 with respect to the longitudinal axis 114. In an example implementation, the left and right pin receivers 292, 294 define +/−10°, 15°, and 20° angles. A greater or lesser number of pin receivers are also contemplated. It is appreciated, that the left and right pin receivers 292, 294 can define any other angular position as required or desired. In other examples, the left and right pin receivers 292, 294 may include discrete holes instead of slots.

Additionally, the guide plate 254 includes an arcuate channel 296 disposed below the pin receivers. The arcuate channel 296 is configured to slidingly receive at least a portion of the guide pin 258 (shown in FIG. 7). The arcuate channel 296 increases performance of the pivoting motion of the arm bracket 206 relative to the second trolley member 240. Additionally, the lateral ends of the arcuate channel 296 can form pivot stops for the arm bracket 206 and define the pivot limits of the arm bracket 206 around the pivot axis. In an example implementation, the pivot limits of the arm bracket 206 are +/−20° relative to the center pin receiver 290 and the centered position.

The second trolley member 240 also includes a swivel rod 298 that extends from the housing 260 and forms a portion of the pivot point for the arm bracket 206. In the example, the swivel rod 298 is fixedly supported on the housing 260 by a pair of cross plates 300.

FIG. 10 depicts an exploded isometric view of the arm bracket 206 and the components supported thereon of the weight arm assembly 200 (shown in FIG. 2). The arm bracket 206 couples between the second trolley member 240 (shown in FIG. 9) and the weight arm 204 (shown in FIG. 7). The arm bracket 206 is substantially U-shaped with two side plates 302, 304 and a base plate 306 with top and bottom slots 305, 307 in each of the side plates 302, 304. The base plate 306 is pivotably coupled to the swivel rod 298 (shown in FIG. 9) of the second trolley member 240 via a swivel tube 308 that mounts to the arm bracket 206 via a plate 310 extending across the side plates 302, 304 and seats within slots 307 at the bottom of the arm bracket 206. The plate 310 may also act as a stop plate to restrict the weight arm 204 from pivoting past the plate 310 and define the downward position as illustrated in FIG. 2. A nut 312 is used to secure the swivel tube 308 on the swivel rod 298. In the example, the swivel tube 308 is disposed proximate to the bottom of the arm bracket 206. The bearing 244 is used to rotatably couple the weight arm 204 to the arm bracket 206 between the two side plates 302, 304. The bearing 244 spans between the two side plates 302, 304 and is approximately centered therein.

The engagement pin 252 and the surrounding, concentric spring 256 are supported within a sleeve 314 connected to an end plate 315 that seats within slots 305 at the top of the arm bracket 206. The end plate 315 can also function as a stop plate to restrict the weight arm 204 from pivoting past the plate and thereby define the upward position as illustrated in FIG. 4. In an example implementation, the end plate 315 may include a plastic pad component 317 to reduce metal on metal contact. The engagement pin 252 is configured to selectively engage with the guide plate 254 (shown in FIG. 9) and define the pivot angle of the arm bracket 206. When the engagement pin 252 is engaged with the guide plate 254, the arm bracket 206 is fixed in position and is not freely rotatable around the pivot axis 248. The engagement pin 252 extends through the base plate 306. Additionally, the base plate 306 supports the guide pin 258. In an example implementation, the guide pin 258 may be a threaded bolt and nut with a spacer that rides within the arcuate channel within the guide plate 254. The side plates 302, 304 also include the plurality of apertures 210 that are configured to selectively receive the weight arm pin 276 as illustrated in FIG. 6.

FIGS. 11 and 12 illustrate different pivot angle positions of the arm bracket 206 relative to the second trolley member 240. As described above, the arm bracket 206 is pivotable relative to the second trolley member 240, and thus relative to the longitudinal axis 114 of the corresponding vertical member 102, around the pivot axis 248 (shown in FIG. 7). The position lock assembly 250 enables the user to selectively engage the engagement pin 252 with the guide plate 254 to define the pivot angle of the arm bracket 206, and thus the weight arm 204 (shown in FIG. 7), for a required or desired exercise. The arm bracket 206 can pivot in either direction around the pivot axis 248.

All directional references (e.g., proximal, distal, upper, lower, upward, downward, left, right, lateral, longitudinal, front, back, top, bottom, above, below, vertical, horizontal, radial, axial, clockwise, counterclockwise, etc.) are only used for identification purposes to aid the reader's understanding of the structures disclosed herein, and do not create limitations, particularly as to the position, orientation, or use of such structures. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto may vary.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise. Moreover, one having skill in the art will understand the degree to which terms such as "about," "approximately," or "substantially" convey in light of the measurement techniques utilized herein. To the extent such terms may not be clearly defined or understood by one having skill in the art, the term "about" shall mean plus or minus ten percent.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC, or A and B and C.

It will be clear that the systems and methods described herein are well adapted to attain the ends and advantages mentioned as well as those inherent therein. The terms "example" and "exemplary," when used in this description, mean "serving as an example, instance, or illustration," and not "preferred" or "advantageous over other examples."

Those skilled in the art will recognize that the methods and systems within this specification may be implemented in many manners and as such is not to be limited by the foregoing examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. A trolley assembly for a weight arm, the trolley assembly comprising a first trolley member configured to be disposed on a first side of a vertical member of a weight rack, the vertical member defining a longitudinal axis;

a second trolley member configured to be disposed on an opposite, second side of the vertical member of the weight rack, the first trolley member couplable to the second trolley member to capture the vertical member of the weight rack therebetween, the trolley assembly being selectively slidable along the longitudinal axis; and an arm bracket further configured to rotatably support the weight arm about a first pivot axis axially transverse to the longitudinal axis and in a plane parallel to the first side of the vertical member; and pivotably coupled to the second trolley member about a second pivot axis that is orthogonal to both the longitudinal axis and the first pivot axis, and that is positioned below the first pivot axis with respect to the longitudinal axis of the vertical member.

2. The trolley assembly of claim 1, further comprising a position lock assembly positioned above the second pivot axis on the arm bracket and configured to lock and unlock an angular position of the arm bracket with respect to the longitudinal axis of the vertical member.

3. The trolley assembly of claim 2, wherein the position lock assembly is positioned above the first pivot axis with respect to the longitudinal axis of the vertical member.

4. The trolley assembly of claim 3, wherein the position lock assembly further comprises an engagement pin supported on the arm bracket and spaced apart from the second pivot axis; and a guide plate coupled to the second trolley member, the guide plate defining two or more pin receivers, wherein the position lock assembly is positionable in at least a first configuration and a second configuration, such that in the first configuration, the engagement pin engages with a first pin receiver to define a first pivot angle of the arm bracket around the second pivot axis relative to the longitudinal axis of the vertical member, and in the second configuration, the engagement pin engages with a second pin receiver to define a second pivot angle of the arm bracket around the second pivot axis relative to the longitudinal axis of the vertical member and the second pivot angle is different than the first pivot angle.

5. The trolley assembly of claim 4, wherein the position lock assembly further comprises a guide pin extending from the arm bracket;

the guide plate further defines an arcuate channel receiving at least a portion of the guide pin; and the arcuate channel defines pivot limits of the arm bracket around the second pivot axis.

6. The trolley assembly of claim 5, wherein the pivot limits of the arm bracket are +/−20° from a center position that is parallel to the longitudinal axis.

7. The trolley assembly of claim 4, wherein the position lock assembly is also positionable in a third configuration such that the engagement pin disengages with the two or more pin receivers and the arm bracket is pivotable around the second pivot axis between at least the first pivot angle and the second pivot angle.

8. The trolley assembly of claim 4, wherein the engagement pin is spring loaded and biased towards an engaged position with the guide plate.

9. The trolley assembly of claim 1 further comprising an adjustment pin supported on the first trolley member and selectively engageable with the vertical member of the weight rack to lock a position of the trolley assembly along the longitudinal axis.

10. The trolley assembly of claim 9 further comprising at least one handle coupled to the first trolley member.

11. The trolley assembly of claim 10, wherein the adjustment pin includes a lever disposed within the at least one handle, connected to the adjustment pin, and operable to engage and disengage the adjustment pin with the vertical member of the weight rack.

12. The trolley assembly of claim 1, the first trolley member and the second trolley member each include at least one roller positionable against the vertical member of the weight rack.

13. A weight arm assembly for a weight rack, the weight arm assembly comprising a trolley assembly configured to couple to a vertical member of the weight rack, the vertical member defining a longitudinal axis and the trolley assembly being selectively slidable along the longitudinal axis on the vertical member, the trolley assembly comprising a first trolley member configured to be disposed on a first side of the vertical member of the weight rack;

a second trolley member configured to be disposed on an opposite, second side of the vertical member of the weight rack, the first trolley member couplable to the second trolley member to capture the vertical member of the weight rack therebetween;

an arm bracket pivotably coupled to the second trolley member about a pivot point, the pivot point defining a pivot axis that is orthogonal to the longitudinal axis; and a weight arm rotatably coupled at a first end to the arm bracket around a rotation axis orthogonal to both the longitudinal axis and the pivot axis and configured to couple to a weight bar member, wherein the rotation axis is located above the pivot axis with respect to the longitudinal axis of the vertical member.

14. The weight arm assembly of claim 13, further comprising a position lock assembly positioned above the pivot axis on the arm bracket and configured to lock and unlock an angular position of the arm bracket with respect to the longitudinal axis of the vertical member.

15. The weight arm assembly of claim 14, wherein the position lock assembly is positioned above the rotation axis with respect to the longitudinal axis of the vertical member.

16. The weight arm assembly of claim 15, wherein the position lock assembly further comprises:

an engagement pin supported on the arm bracket spatially apart from the pivot point; and a guide plate coupled to the second trolley member and defining two or more pin receivers, wherein the engagement pin is selectively engageable within a respective pin receiver of the two or more pin receivers to define a respective pivot angle of the arm bracket relative to the second trolley member, and the weight arm is rotatable around the rotation axis at each respective pivot angle of the arm bracket.

17. The weight arm assembly of claim 13, wherein the arm bracket is substantially U-shaped with two side plates and a base plate;

the base plate is pivotably coupled to the second trolley member; and the weight arm is rotatably coupled between the two side plates.

18. The weight arm assembly of claim 17, wherein the arm bracket further comprises a weight arm pin;

the two side plates each define a plurality of apertures spaced apart relative to the rotation axis; and the weight arm is selectively positionable about the rotation axis relative to the arm bracket via engagement between the weight arm pin and respective apertures of each of the plurality of apertures of the two side plates.

19. The weight arm assembly of claim 17, wherein a stop plate extends within the arm bracket, the stop plate at least partially defining a parallel orientation of the weight arm relative to the vertical member of the weight rack.

20. The weight arm assembly of claim 13, further comprising an adjustment pin supported on the first trolley member and selectively engageable with the vertical member of the weight rack to lock a position of the trolley assembly along the longitudinal axis.

* * * * *